US009528218B1

(12) United States Patent
Love

(10) Patent No.: US 9,528,218 B1
(45) Date of Patent: Dec. 27, 2016

(54) SHOWER CAP SUPPORT

(71) Applicant: James A. Love, Meridian, MS (US)

(72) Inventor: James A. Love, Meridian, MS (US)

( * ) Notice: Subject to any disclaimer, the term of this patent is extended or adjusted under 35 U.S.C. 154(b) by 0 days.

(21) Appl. No.: 14/622,329

(22) Filed: Feb. 13, 2015

Related U.S. Application Data

(60) Provisional application No. 61/966,503, filed on Feb. 25, 2014.

(51) Int. Cl.
*D06F 57/00* (2006.01)
*A47G 25/10* (2006.01)

(52) U.S. Cl.
CPC ..... *D06F 57/00* (2013.01); *A47G 25/10* (2013.01)

(58) Field of Classification Search
CPC ..... D06F 57/00; A47G 25/10
USPC ..... 211/30, 85.3; 223/15, 24, 25, 26
See application file for complete search history.

(56) References Cited

U.S. PATENT DOCUMENTS 1,410,468 A * 3/1922 Glenn ..... A47G 25/10 160/252
5,197,292 A * 3/1993 McPherson ..... A42B 1/008 2/7
5,557,807 A * 9/1996 Hujar ..... A42B 1/008 2/171.2
5,992,045 A * 11/1999 Kellogg ..... F26B 25/18 160/370.21
6,792,624 B2 * 9/2004 Simmons ..... A42C 5/04 2/171.2
7,681,253 B2 * 3/2010 Kobayashi ..... A41D 27/13 2/209.13
8,117,677 B2 * 2/2012 Toth ..... A42B 3/121 2/413
8,191,742 B1 * 6/2012 Brewer ..... A42B 1/002 223/12

FOREIGN PATENT DOCUMENTS

GB 604638 A * 7/1948 ..... A42C 1/02

* cited by examiner

*Primary Examiner* — Stanton L Krycinski
(74) *Attorney, Agent, or Firm* — H. John Rizvi; Gold & Rizvi P.A.

(57) ABSTRACT

A shower cap support to aid in the storage and drying of a wet shower cap includes a circular covering having a first side formed of a water absorbent material and a second side opposite of the first side and peripherally affixed thereto. In combination the sides define an interior cavity wherein the cover is foldable upon itself along a diametrical fold line. A bifurcated substantially circular body is disposed within the interior cavity and comprises first and a second rigid semi-circular elements were in the elements are disposed slightly one from the other. The first side of the circular cover is fastened to the second side of the circular cover on at least two locations substantially along the fold line and between the rigid elements.

13 Claims, 5 Drawing Sheets

SHOWER CAP SUPPORT

CROSS-REFERENCE TO RELATED APPLICATION

This Non-Provisional Utility application claims the benefit of U.S. Provisional Patent Application Ser. No. 61/966,503, filed on Feb. 25, 2014, which is incorporated herein in its entirety.

FIELD OF THE INVENTION

The present disclosure generally relates to apparatuses and methods for storing and drying shower caps. More particularly, the present disclosure relates to a support for the placement of a shower cap for storage and drying between showers.

BACKGROUND OF THE INVENTION

Bathing, while frowned upon in centuries past and mostly tolerated as an infrequent exercise, and as late as the turn of the $20^{th}$ century considered to be a weekly Saturday night ritual, is now considered to be essential to basic personal hygiene on almost a daily schedule. While many individuals continue to bathe in tubs of water for relaxation, showering has become ever more increasingly popular. Men will often bathe and shower to both cleanse their body and wash their hair. However, many women do not wash their hair as often, have their hair professionally coiffed, or desire to wash their hair elsewhere. Consequently, women, and even some men, prefer to cover their hair with a shower cap while they bathe or shower.

A shower cap, also known as a bath cap, is a hat worn while showering or bathing to protect one's hair from becoming wet. Many shower cap designs are comprised of two joined layers of fabric to make the shower cap both waterproof and decorative; however, in its simplest design, a shower cap comprises a single layer of a waterproof material and an edge of an elasticized material so that the shower cap fits snugly around a user's head to keep the hat in place and to minimize any water leakage around the edges of the shower cap.

Once the wearer of a shower cap has completed showering or bathing, the shower cap is typically wet. Consequently, the wearer must find somewhere to place the shower cap while it dries since placing the wet shower cap in a drawer or other enclosed area has a high potential for the formation of mold and mildew on the shower cap. Often, the individual removes the shower cap and hangs it from a handle of the faucet, the bathtub waterspout, the showerhead, or a doorknob. While this may be acceptable for households wherein the wearer is the only member, in households of two or more individuals sharing the same bath, these and other locations become impractical and actually interfere with another's use of the bathing facility.

Therefore, a device is needed to facilitate both the storage and the drying of a wet shower cap in an area that does not interfere with the use of the bathing facility by an individual other than the wearer of the shower cap.

SUMMARY OF THE INVENTION

The present disclosure is generally directed to a shower cap support to aid in the storage and drying of a wet shower cap. The shower cap support includes a flexible circular covering having a first side and a second side opposite of the first side and peripherally affixed thereto. In combination the sides define an interior cavity wherein the cover is foldable upon itself along a diametrical fold line. A bifurcated substantially circular body is disposed within the interior cavity and comprises a first rigid semicircular element and a second rigid semicircular element wherein the elements are disposed slightly one from the other. The first side of the circular cover is fastened to the second side of the circular cover on at least two locations substantially along the fold line and between the rigid elements.

In another aspect, the diameter of the circular body is within the range of 12 to 16 inches.

In yet another aspect, the diameter of the circular body is substantially 14 inches In yet another aspect, the first side is formed of a water absorbent material.

In a still further aspect, the water absorbent material of the first side of the circular cover is terrycloth.

In another aspect, the second side of the circular cover comprises a flexible fabric.

In another aspect, the first and second semicircular planar elements are formed from one of a group consisting of wood and plastic.

In a still further aspect, the second side of the circular cover defines a diametrical slit for receiving the first and second semicircular planar elements therethrough.

In yet another aspect, the shower cap support further includes a fabric strip affixed to an exterior surface of the second side of the circular cover, the fabric strip covering the slit.

In another aspect, the first side of the circular cover is fastened to the second side of the circular cover at a plurality of stitch points, wherein at least two of the stitch points are on one side of the slit intermediate to the slit and the first planar element and wherein at least two stitch points are on an opposite side of the slit intermediate to the slit and the second planar element.

In still another aspect, a shower cap support to aid in the storage and drying of a wet shower cap includes a flexible circular cover having a first side formed of a water absorbent material and a second side formed of a second fabric opposite of the first side and peripherally affixed thereto. The first side and the second side in combination define an interior cavity whereupon the circular cover is foldable upon itself along a diametrical fold line. A bifurcated substantially circular body has a diameter less than a diameter of the circular cover inner cavity and is disposed within the circular cover interior cavity. The bifurcated body comprises a first rigid semicircular planar element and a second rigid semicircular planar element; each element disposed one from the other. The first side of the circular cover is fastened to the second side of the circular cover intermediately between the first and second rigid planar elements maintaining the first rigid planar element disposed apart from the second rigid planar element.

In yet another aspect, the diameter of the circular body is within the range of 12 to 16 inches.

In another aspect, the second side of the circular cover defines a diametrical slit for receiving the first and the second semicircular planar elements therethrough.

In still another aspect, the shower cap support further includes a fabric strip affixed to an exterior surface of the second side of the circular cover, the fabric strip covering the slit.

In yet another aspect, the first side of the circular cover is fastened to the second side of the circular cover at a plurality of stitch points, wherein at least two of the stitch points are on one side of the slit intermediate to the slit and the first planar element and wherein at least two of the stitch points are on opposite side of the slit intermediate to the slit and the second planar element.

In a still further aspect, a shower cap support to aid in the storage and drying of a wet shower cap includes a flexible cover having a first side formed of a water absorbent material and a second side formed of a second fabric opposite of the first side and peripherally affixed thereto. The first side and the second side in combination define an interior cavity wherein the second side further defines a slit separating the interior cavity into a first pocket and a second pocket. The cover is foldable upon itself along a diametrical fold line. A diametrically bifurcated body has a width less than a width of the cover interior cavity, and comprises a first rigid planar element received in the first pocket and a second rigid planar element received in the second pocket. The first and the second planar elements are disposed apart one from the other. The first side of the cover is fastened to the second side of the cover intermediate to the first and the second rigid planar elements maintaining the first rigid planar element disposed from the second rigid planar element.

In another aspect, the first side of the cover is fastened to the second side of the cover at a plurality of stitch points, wherein at least two of the stitch points on one side of the slit intermediate to the slit and the first planar element and wherein at least two of the stitch points are on an opposite side of the slit intermediate to the slit and the second planar element.

In another aspect, a fabric strip is affixed to an exterior surface of the second side of the cover such that the fabric strip covers the slit.

In a still further aspect, a width of the body is within the range of 12-16 inches.

In yet another aspect, a width of the body is substantially 14 inches.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

Figure 1:
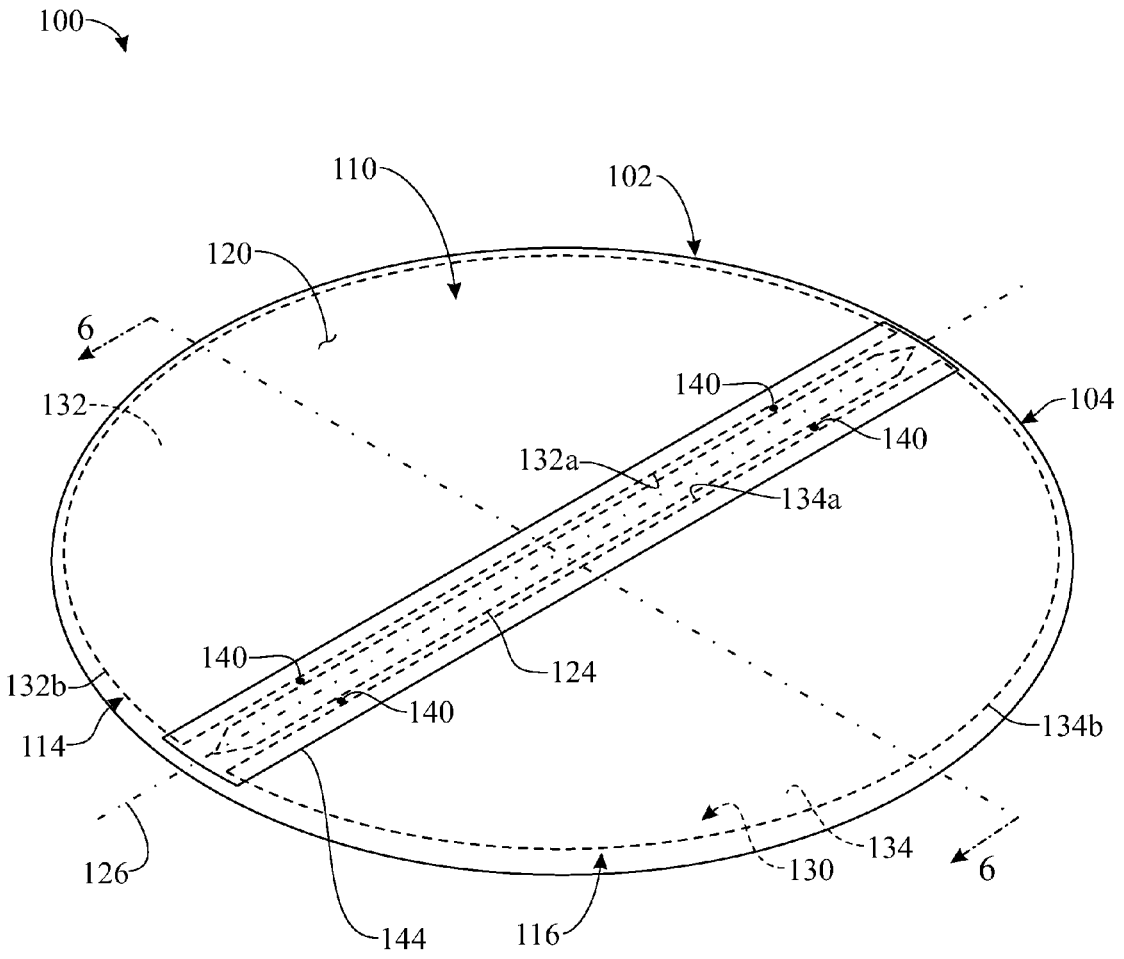
FIG. 1 presents a bottom plan view of a shower cap support embodying the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
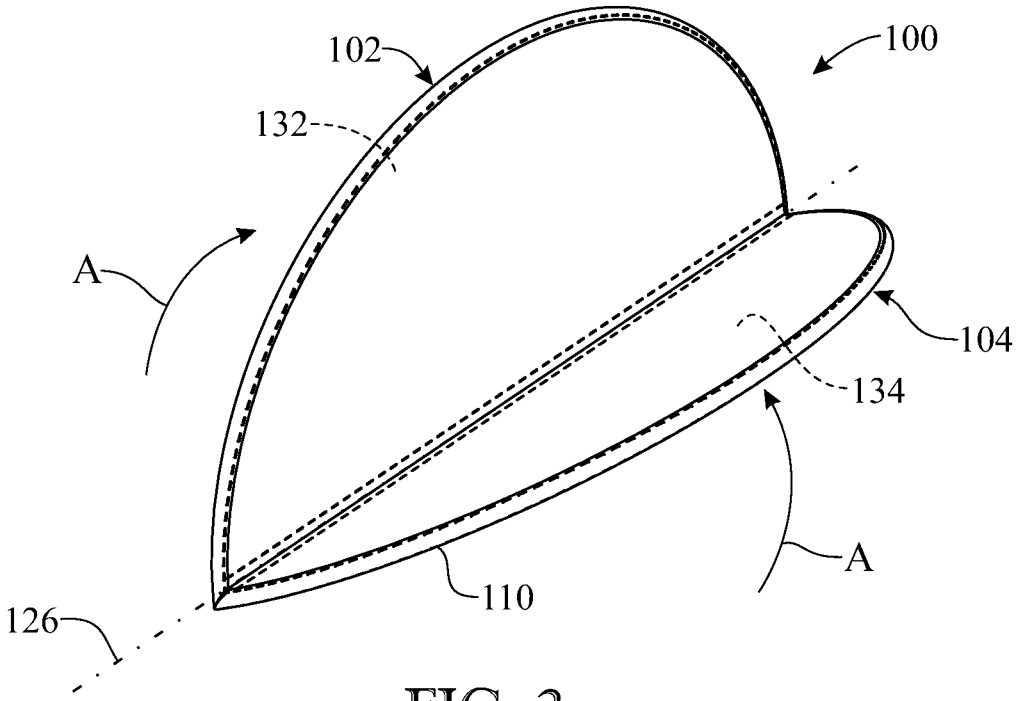
FIG. 2 presents a top isometric view of the shower cap support partially folded.
Figure 3:
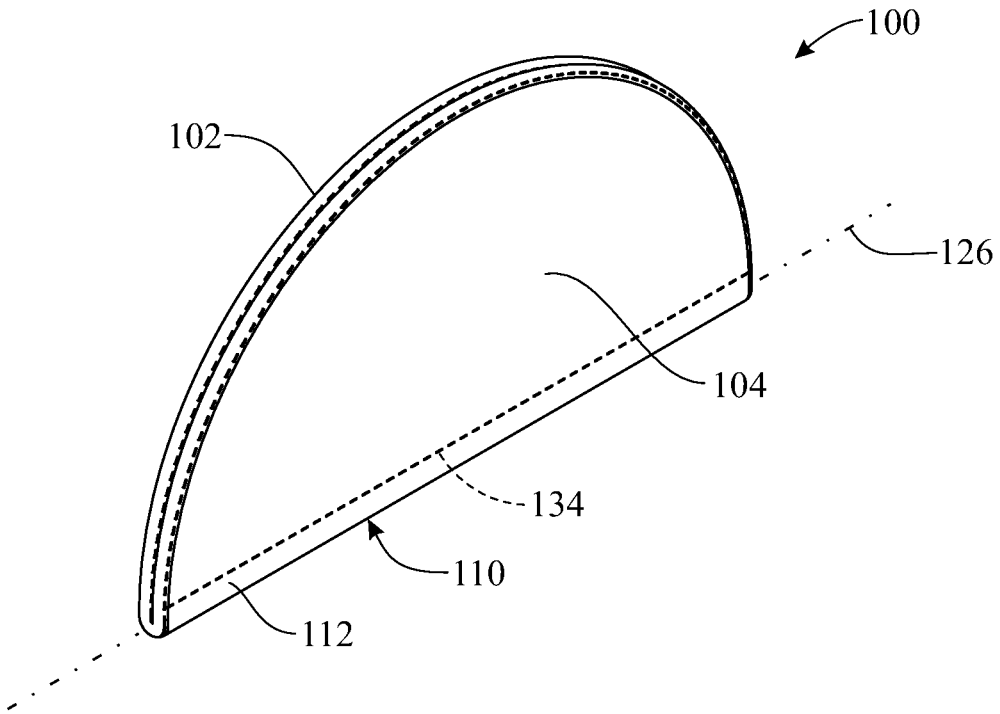
FIG. 3 presents a top isometric view of the shower cap support in a folded configuration.

In one exemplary implementation of the invention, a shower cap support 100 for aiding in the storage and drying of a shower cap is shown in FIGS. 1 through 6 illustrating its various components where a diametrically bifurcated body 130 is housed in a flexible circular cover 110 and is foldable upon itself as shown in FIGS. 2 and 3 along a diametrical fold line 126 by arcuately translating a first wing 102 toward a second wing 104 as illustrated by arrows "A", FIG. 2, until first wing 102 and second wing 104 abut one another.

Referring now to FIGS. 1, and 4 through 6, a shower cap support 100 has a circular inner body 130 which is comprised of a first rigid planar element 132 and a second rigid planar element 134. The first and second rigid planar elements 132, 134 are generally semi-circular, each comprising a respective diametrical base 132*a*, 134*a* and a respective semi-circular outer edge 132*b*, 134*b*. The first and second rigid planar elements 132, 134 are positioned proximate one to the other with their diametrical bases 132*a*, 134*a* opposed one to the other and disposed one from the other. The rigid planar elements 132, 134 are typically constructed of wood, plastic, or other material that can be readily cut and shaped and is generally impervious to water. The diameter of the circular body 130 is generally within the range of 12-16 inches, and in a most preferred embodiment the diameter is substantially 14 inches.

Figure 4:
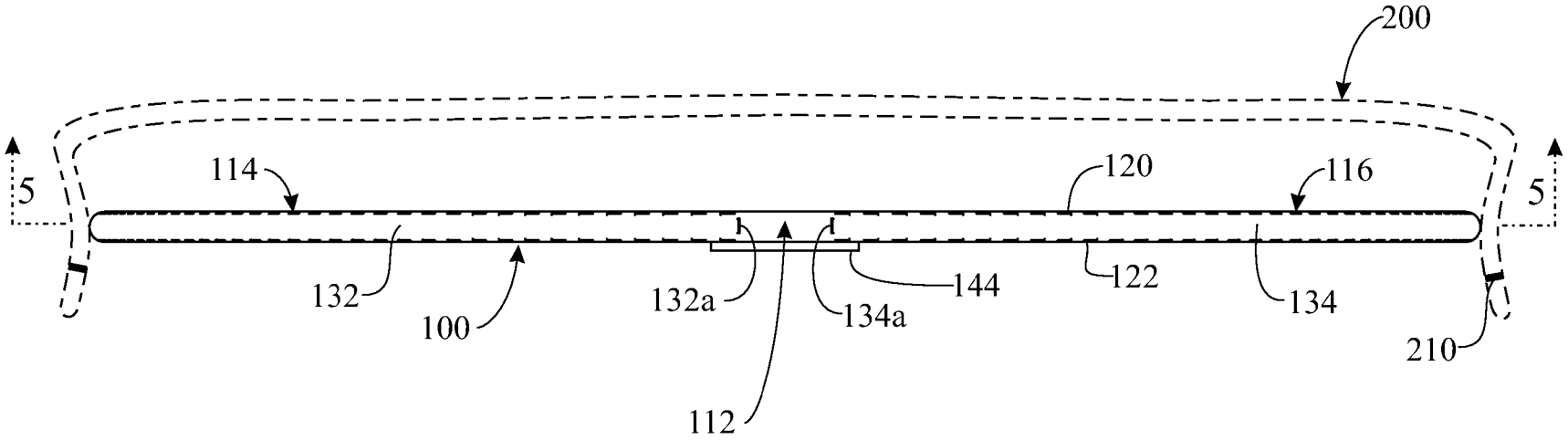
FIG. 4 presents a left side elevation view of the shower cap support with a shower cap fitted over the shower cap support.
Figure 5:
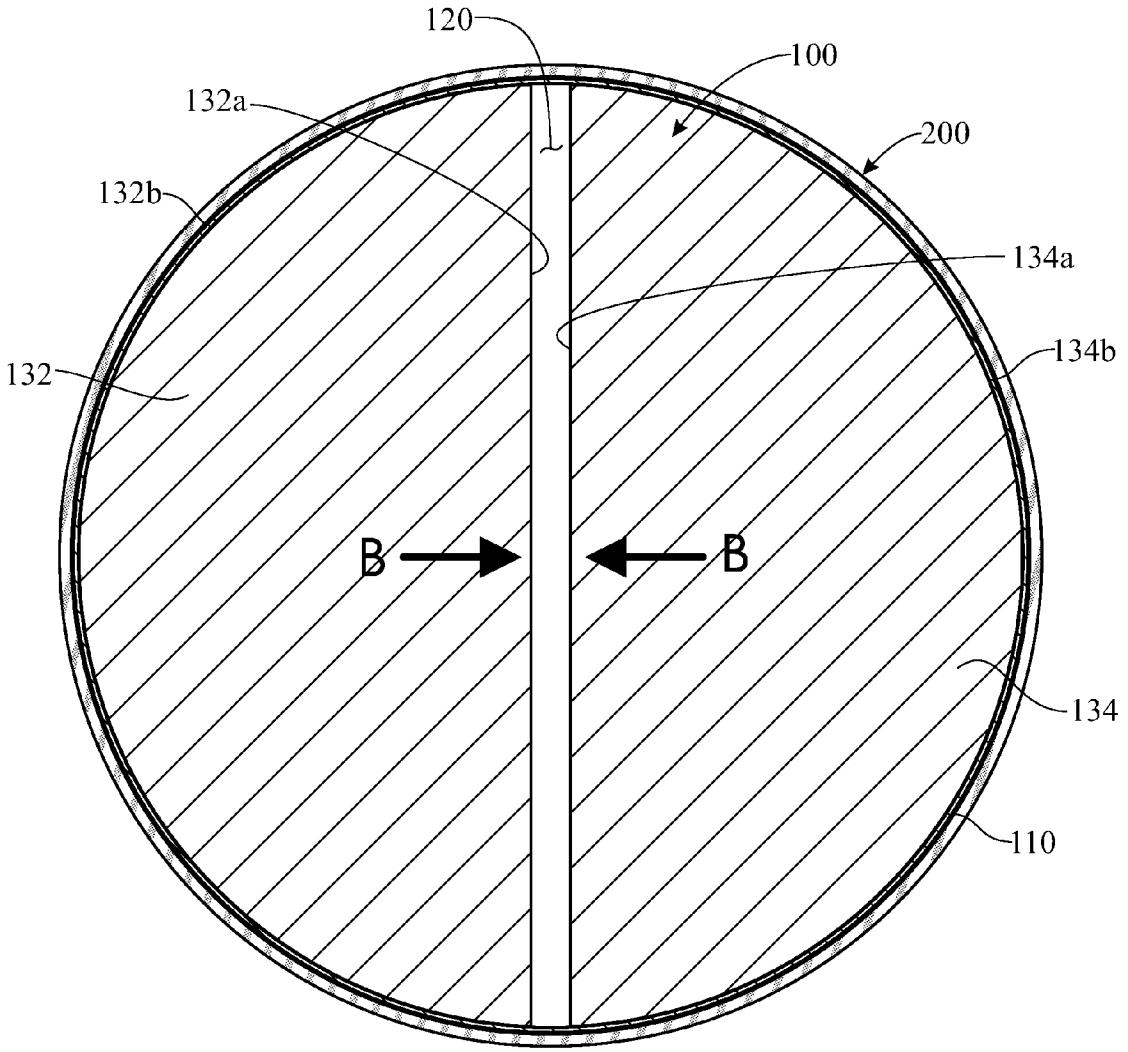
FIG. 5 presents a cross-sectional top plan view of the shower cap support shown in FIG. 4 and taken along the line 5-5 indicated in FIG. 4.
Figure 6:
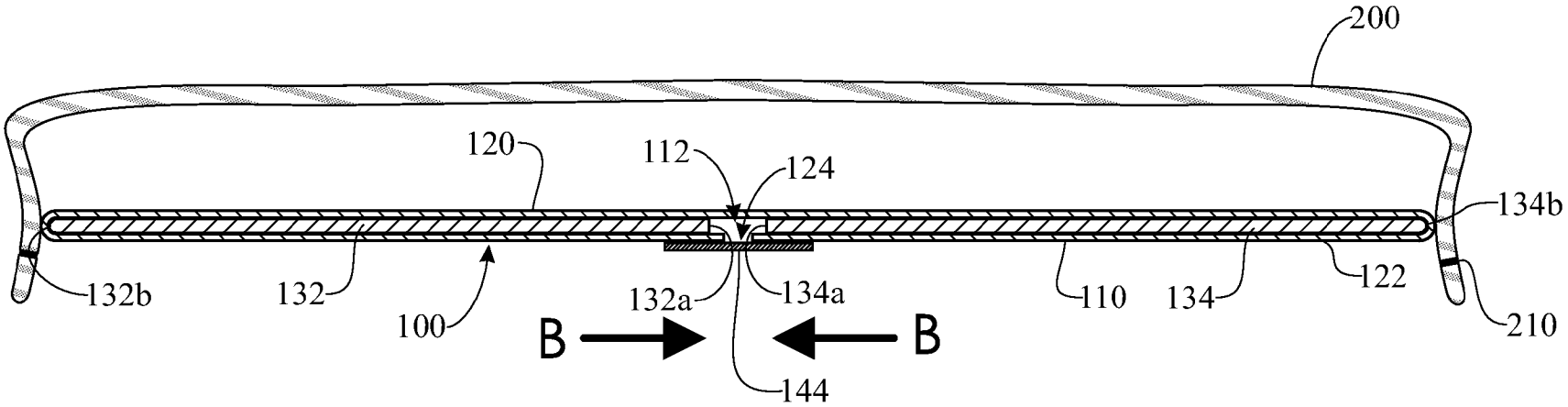
FIG. 6 presents a side elevation cross-sectional view of the shower cap support shown in FIG. 1 and taken along the line 6-6 indicated in FIG. 1 and showing a shower cap engaged on the support.

The rigid planar elements 132, 134 of the circular body 130 are retained in an interior cavity 112 of a circular cover 110 which is of a diameter greater than the diameter of the circular body 130. As best shown in FIG. 4, the circular cover 110 of the present embodiment includes a first side 120 constructed of a water absorbent material such as terrycloth which may have fabric loops on one or both sides thereof and a second side 122 peripherally affixed to the first side 120 and constructed of a flexible cloth of a standard flat weave. The terrycloth fabric loops of the first side 120 are anticipated to be on the exterior surface of the circular cover 110 for the purpose of absorbing water which may come in contact therewith.

The second side 122 can further define a diametrical slit 124 which generally extends along the diametrical fold line 126 and extends from peripheral edge to peripheral edge of the circular cover 110. The slit 124 divides the interior cavity 112 into a first pocket 114 and a second pocket 116. The purpose of the slit 124 is to facilitate the insertion of the first rigid planar element 132 into the first pocket 114 and the insertion of the second rigid planar element 134 into the second pocket 116. The rigid planar elements 132, 134 are arranged such that their hemispherical bases are opposed one to the other and disposed one from the other. To positionally retain the rigid planar elements in their disposed orientation, the second side 122 is fastened to the first side 120 in a plurality of locations proximate to the slit 124. In a most preferred embodiment, the second side 122 is stitched to the first side 120 at a plurality of stitch points 140 (four stitch points 140 being included in the present embodiment), each stitch point 140 having, for instance, a minimum of four stitches of thread. At least two stitch points 140 are positioned intermediate of the slit 124 and the first planar element 132 to retain the first planar element 132 in the pocket 114. In like manner, at least two stitch points 140 are positioned intermediate of the slit 124 and the second planar element 134 to retain the second planar element 134 in the pocket 116. Those practiced in the art will readily recognize that other forms of fastening such as snaps, plastic rivets, etc., can be utilized to affix the first side 120 to the second side 122.

A fabric strip 144 is affixed to the second side 122 in a manner to cover the slit 124. The fabric strip 144 is generally 1 inch wide and slightly longer than the length of the slit 124. The fabric strip 144 can be glued utilizing a water impervious glue, or, as in a more preferred embodiment, a fabric seam tape can be applied between the periphery of the fabric strip 144 and the second side 122 and then applying heat with a hot iron to activate the seaming tape and thereby bond the fabric strip 144 to the second side 122.

Construction of the shower cap support 100 can be accomplished by first obtaining a relatively thin, i.e. ⅛ inch, piece of material such as wood or plastic which is generally impervious to water and then cutting the body 130 into a circle of the desired diameter, i.e. 14 inches. The body 130 is then cut diametrically into equal halves to obtain the first and the second rigid semicircular planar elements 132, 134. The cut edges of the planar elements 132, 134 can be abraded to smooth any rough areas.

A water absorbent material such as terrycloth is chosen for the first side 120 and a smoother generally flat, flexible weave cloth is chosen for the second side 122 wherein both are cut to a diameter substantially 2 inches greater than the diameter of the body 130, i.e. 16 inches.

The circles of material are arranged to be in registration one with the other with the material sides desired to be exposed as the exterior of the cover 110 facing one to the other. A circular seam of a diameter slightly less than the diameter of the body 130, i.e. 14 inches, is centered on the circular sides 120, 122 and stitched to affix the side 120 to the side 122 to form the circular cover 110.

The slit 124 is cut diametrically across the second circular side 122 from stitched seam to stitched seam. The circular cover 110 is then turned inside out through the slit 124 so that the surfaces of the first side 120 and the second side 122 which were interior to the cover 110 are now exterior to the cover 110 and form a first pocket 114 on a first side of the slit 124 and a second pocket 116 on a second side of the slit 124.

The first planar element 132 is inserted in the first pocket 114 and the second planar element 134 is inserted in the second pocket 116.

At least two stitch points 140 comprising, for instance, at least four stitches of thread each are made intermediately between the slit 124 and the first planar element 132 to retain the first planar element 132 in the first pocket 114. In like manner, at least two stitch points 140 are made intermediately between the slit 124 and the second planar element 134 to retain the second planar element 134 in the second pocket 116. Each stitch point being more proximate to an outer periphery of the circular cover 110 then to a center of the circular cover 110.

A 1-inch wide fabric strip 144, preferably of the same material as the second side 122, is cut to a length to cover the slit 124. The fabric strip 144 is bonded to the second side 122 over the slit 124 utilizing fabric seam tape at the edges of the fabric strip 144 and activated by using a hot iron on the surface of the fabric strip 144.

In use, as shown in FIG. 4, the elastic peripheral edge 210 of a shower cap 200 is engaged over the periphery of the shower cap support 100 thereby supporting the shower cap 200 in an expanded configuration to permit the wet outer surface of the shower cap 210 rapidly arrow dry. Compression of the elastic peripheral edge 210 exerts a radially inward force against the circular outer edges 132*b*, 134*b* of the first rigid planar element 132 and the second rigid planar element 134. This radially inward force, together with the fact that the circular cover 110 is flexible, causes the first end second rigid planar elements 132, 134 to come together as indicated by arrows B in FIGS. 5 and 6, and their straight, diametrical bases 132*a*, 134*a* to become adjacent one another (only separated by the stitch points 140) providing a stable, planar circular inner body 130 supporting the shower cap 200 in a deployed position. In other words, when the shower cap support 100 is placed inside the shower cap 200 as shown in FIG. 4, the elastic edge 210 of the shower cap compresses against the shower cap support 100 and generally eliminates internal gaps within the shower cap support 100, bringing the first and second rigid planar elements 132, 134 towards one another to form a stably supporting, circular inner body 130.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What I claim is:

1. A shower cap support to aid in the storage and drying of a wet shower cap, said shower cap support comprising:

a flexible circular cover having a first side and a second side opposite of said first side and peripherally affixed thereto and in combination defining an interior cavity, said circular cover foldable upon itself along a diametrical fold line;

a bifurcated substantially circular body disposed within said interior cavity, said bifurcated body comprising a first rigid semicircular planar element and a second rigid semicircular planar element, said first and said second semicircular elements disposed slightly one from the other;

a diametrical slit defined on said second side of said circular cover for receiving said first and said second semicircular planar elements therethrough; and a fabric strip affixed to an exterior surface of said second side of said circular cover, said fabric strip covering said slit; wherein said first side of said circular cover is fastened to said second side of said circular cover on at least two locations substantially along said fold line between said first and said second rigid elements; and further wherein said first side of said circular cover is fastened to said second side of said circular cover at a plurality of stitch points, wherein at least two of said stitch points are on one side of said slit intermediate to said slit and said first planar element and wherein at least two stitch points are on an opposite side of said slit intermediate to said slit and said second planar element.

2. A shower cap support according to claim 1 wherein a diameter of said circular body is within the range of 12 to 16 inches.

3. A shower cap support according to claim 2 wherein said diameter of said circular body is substantially 14 inches.

4. A shower cap support according to claim 1 wherein said first side is formed of a water absorbent material.

5. A shower cap support according to claim 4 wherein said water absorbent material of said first side of said circular cover is terrycloth.

6. A shower cap support according to claim 1 wherein said second side of said circular cover comprises a flexible fabric.

7. A shower cap support according to claim 1 wherein said first and said second semicircular planar elements are formed from one of a group consisting of wood and plastic.

8. A shower cap support to aid in the storage and drying of a wet shower cap, said shower cap support comprising:

a flexible circular cover having a first side formed of a water absorbent material and a second side formed of a second fabric opposite of said first side and peripherally affixed thereto, said first side and said second side in combination defining an interior cavity, said circular cover foldable upon itself along a diametrical fold line;

a bifurcated substantially circular body having a diameter less than a diameter of said circular cover interior cavity and disposed within said circular cover interior cavity, said bifurcated body comprising a first rigid semicircular planar element and a second rigid semicircular planar element, said first and said second semicircular elements disposed one from the other;

a diametrical slit defined on said second side of said circular cover for receiving said first and said second semicircular planar elements therethrough; and a fabric strip affixed to an exterior surface of said second side of said circular cover, said fabric strip covering said slit; wherein said first side of said circular cover is fastened to said second side of said circular cover intermediate to said first and said second rigid planar elements maintaining said first rigid planar element disposed from said second rigid planar element; and further wherein said first side of said circular cover is fastened to said second side of said circular cover at a plurality of stitch points, wherein at least two of said stitch points are on one side of said slit intermediate to said slit and said first planar element and wherein at least two of said stitch points are on an opposite side of said slit intermediate to said slit and said second planar element.

9. A shower cap support according to claim 8 wherein a diameter of said circular body is within the range of 12 to 16 inches.

10. A shower cap support to aid in the storage and drying of a wet shower cap, said shower cap support comprising:

a flexible cover having a first side formed of a water absorbent material and a second side formed of a second fabric opposite of said first side and peripherally affixed thereto, said first side and said second side in combination defining an interior cavity wherein said second side further defines a slit separating said interior cavity into a first pocket and a second pocket, said cover foldable upon itself along a diametrical fold line;

a diametrically bifurcated body having a width less than a width of said cover interior cavity, said bifurcated comprising a first rigid planar element received in said first pocket and a second rigid planar element received in said second pocket, said first and said second planar elements disposed apart one from the other; wherein said first side of said cover is fastened to said second side of said cover intermediate to said first and said second rigid planar elements maintaining said first rigid planar element disposed from said second rigid planar element; and further wherein said first side of said cover is fastened to said second side of said cover at a plurality of stitch points, wherein at least two of said stitch points are on one side of said slit intermediate to said slit and said first planar element and wherein at least two of said stitch points are on an opposite side of said slit intermediate to said slit and said second planar element.

11. A shower cap support according to claim 10 further including a fabric strip affixed to an exterior surface of said second side of said cover, said fabric strip covering said slit.

12. A shower cap support according to claim 11 wherein a width of said body is within the range of 12-16 inches.

13. A shower cap support according to claim 12 wherein a width of said body is substantially 14 inches.

* * * * *